US005135139A

United States Patent [19]

Krawagna

[11] Patent Number: 5,135,139

[45] Date of Patent: Aug. 4, 1992

[54] ROTARY COVER FOR CLOSING THE AXIAL OPENING OF A HOLLOW-CYLINDRICAL BODY

[75] Inventor: Louis A. Krawagna, Toronto, Canada

[73] Assignee: Creanova AG, Zurich, Switzerland

[21] Appl. No.: 504,119

[22] Filed: Apr. 3, 1990

[30] Foreign Application Priority Data

Apr. 10, 1987 [DE] Fed. Rep. of Germany ... 8904496[U]

[51] Int. Cl.[5] ..... B67D 3/00; B67D 5/06

[52] U.S. Cl. ..... 222/520; 222/549; 222/519; 222/535

[58] Field of Search ..... 222/519–525, 222/548–555, 566–574

[56] References Cited

U.S. PATENT DOCUMENTS

| | | | |
|---|---|---|---|
| 1,917,833 | 7/1933 | Finely | 222/519 |
| 1,997,863 | 4/1935 | Hansen | 222/549 X |
| 2,129,687 | 9/1938 | Hansen | 222/549 X |
| 3,342,385 | 9/1967 | Knight | 222/498 X |
| 3,355,067 | 11/1967 | Espinal | 222/23 |
| 3,357,605 | 12/1967 | Chadfield | 222/498 X |
| 3,370,764 | 2/1968 | Stull | 222/521 X |
| 4,234,093 | 11/1980 | Tyson | 222/520 X |

FOREIGN PATENT DOCUMENTS

| | | |
|---|---|---|
| 0081124A1 | 11/1982 | European Pat. Off. . |
| 1960248 | 5/1967 | Fed. Rep. of Germany . |
| 2644947A1 | 10/1976 | Fed. Rep. of Germany . |
| 2624354A1 | 12/1977 | Fed. Rep. of Germany . |
| 2157690 | 8/1973 | France . |

*Primary Examiner*—Michael S. Huppert
*Assistant Examiner*—Kenneth DeRosa
*Attorney, Agent, or Firm*—Hubbard, Thurman, Tucker & Harris

[57] ABSTRACT

A rotary cover for closing the axial opening of a hollow-cylindrical body, a rotary cap and said body having corresponding cam threads, which cause an axial displacement of the rotary cap relative to the body when the rotary cap is rotated. Axial sides of the rotary cap and of the body, which face each other, extend in a plane inclined by a specific angle $\alpha$ relative to the axis of the body. These axial sides of the rotary cap and of the body are in alignment with each other in the closed position of the rotary cover.

6 Claims, 9 Drawing Sheets

ROTARY COVER FOR CLOSING THE AXIAL OPENING OF A HOLLOW-CYLINDRICAL BODY

Figure 1:
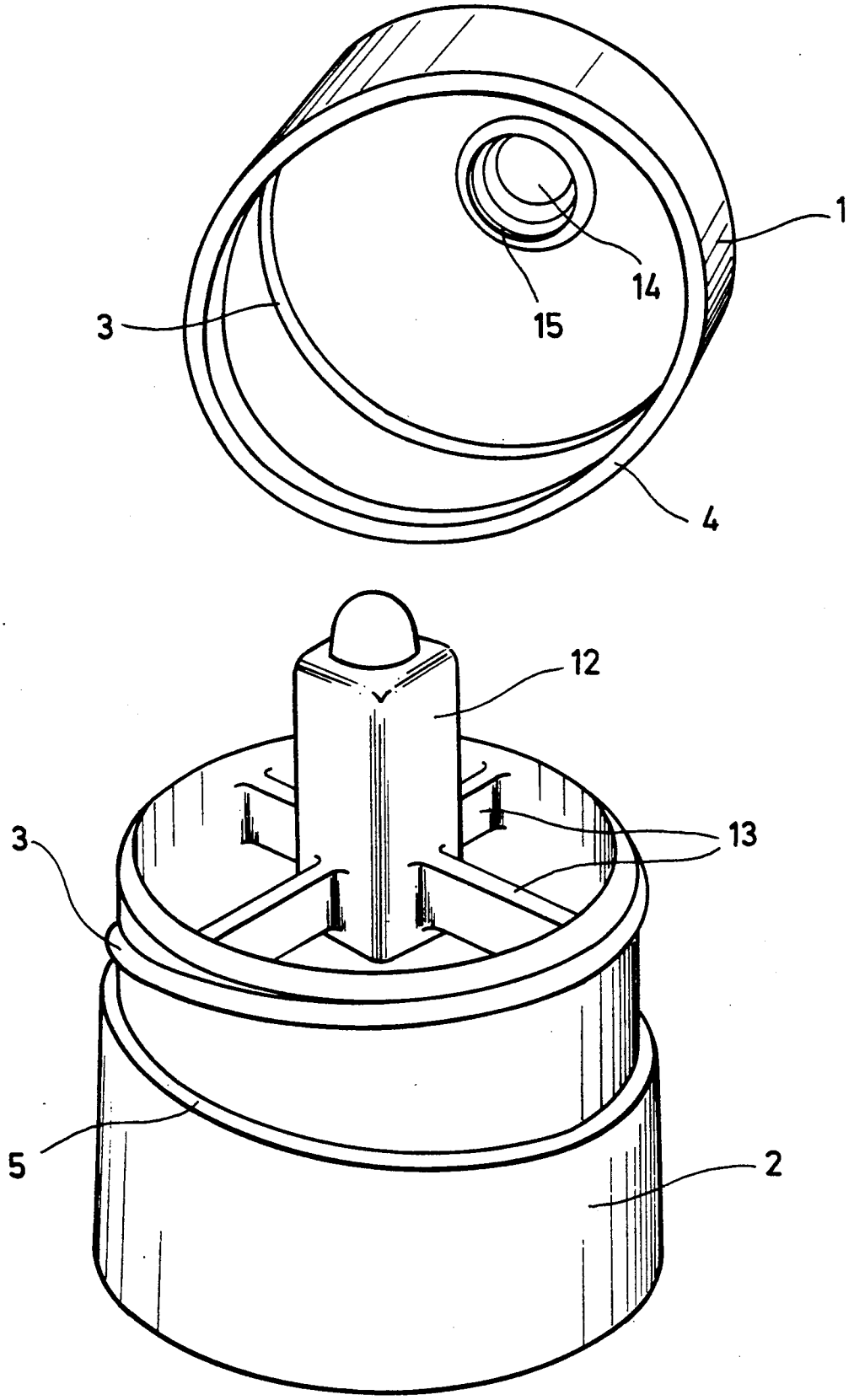

The present invention refers to a rotary cover for closing the axial opening of a hollow-cylindrical body.

Such rotary covers are used e.g. for closing receptacles, which serve to receive therein a liquid or a powdery filling material and which are adapted to discharge said material in the open condition of the rotary cover. In this case, the body which is to be closed by the rotary cover can define the receptacle itself, or it can be constructed as a body which belongs to the rotary cover and which is screwed onto the neck of a receptacle with the aid of a female or a male thread.

In the case of a rotary cover known from German Utility Model 19 60 248, a plug defining the body is inserted in the neck of a receptacle with the aid of a one-piece spring means. The plug consists of a coaxial central post carrying at its axial end a valve body, which cooperates with an axial through hole of the rotary cap. With the aid of the spring means, the coaxial central post and, consequently, also the valve body can be pressed axially inwards in the closed condition of the rotary cover, whereby the through hole provided in the rotary cap is opened so that the receptacle can be filled from outside. for discharging the filling material contained in the receptacle, the rotary cap is partly unscrewed, whereby the through hole of the rotary cap moves away from the valve body in the axial direction and opens thus a free discharge cross-section. The spring means holding the plug or rather the central post comprises radial ribs, which are secured in position on the inner circumferential surface of the body and which are connected to the coaxial central post.

The present invention is based on the task of further developing a rotary cover of this type in such a way that it can be produced in a simple manner and permits easy handling as well as unhindered discharge of filling material contained in the body.

In the case of a rotary cover of the above-mentioned type, this task is solved by the features disclosed in the characterizing clause of claim 1.

The rotary cover according to the present invention is characterized by the feature that, when rotated relative to the body by 180°, it carries out an axial displacement relative to said body with the aid of the cam thread. In the case of this axial displacement, the rotary cap is, however, not detached from the body in the open position of the receptacle, but an opening, which is axially or radially provided in the rotary cap, is uncovered so that filling material contained in said body can be discharged outwards. The axial sides of the rotary cap as well as of the body, which face each other, extend in a plane inclined by a specific angle relative to the axis of the body. In the closed position of the rotary cover these bevelled sides are in alignment with each other, whereas they diverge in the open position of the rotary cover.

Although, in the case of normal operation, the rotary cap and the body of the rotary cover are separated not even in the open position, they are produced preferably from plastic material as separate individual components, whereby they can have different colors so as to optimize the aesthetic impression conveyed by the rotary cover.

Further developments of the present invention are disclosed in the subclaims.

Embodiments of the present invention are explained in detail on the basis of the drawing, in which the individual figures show:

FIG. 1 a perspective view of a first embodiment of the rotary cover, the rotary cap being fully detached from the body only for the purpose of providing a clearer representation, FIG. 2*a* to 2*e* top views and sectional views of the body and of the rotary cap of the rotary cover shown in FIG. 1, said body and said rotary cap being shown individually as well as in an interconnected condition, FIG. 3*a* to 3*f* sectional views and top views of the body of a different embodiment of the rotary cover, FIG. 4*a* to 4*f* schematic representations of the body and of the rotary cap of a rotary cover in the form of a modified embodiment of FIG. 3, FIG. 5*a* to 5*e* various views of an additional embodiment of the rotary cover, FIG. 6*a* to 6*e* an additional embodiment of the rotary cover reppresenting a modification of the embodiment shown in FIG. 5, and FIG. 7*a* to 7*c* a different embodiment of the rotary cover, which serves to explain the manifold possibilities of using the rotary cover according to the present invention.

The rotary cover, a perspective view of which is shown in FIG. 1, consists of a rotary cap 1 and of a body 2. Although the cap 1 is not detached from the body 2 when the rotary cover is used in the normal way, the cap 1 is shown separately from the body 2 in said FIG. 1 so as to illustrate the structural design of the rotary cover more clearly. In the case of this first embodiment of the rotary cover, which is explained in detail on the basis of FIG. 2*a* to 2*e*, the rotary cap 1 and the body 2 include corresponding cam threads 3, which effect an axial displacement of the rotary cap 1 relative to the body 2, when the rotary cap 1 carries out a rotation about the axis of the body 2 through an angle of rotation of approx. 180°. The axial sides 4 and 5 forming part of the rotary cap 1 and of the body 2 and facing each other are inclined by a specific angle $\alpha$ relative to the axis. The size of the angle $\alpha$ depends on the pitch of the cam thread 3. The body 2 is provided with a central post 12 secured to the inner circumferential surface of the body 2 via ribs 13. The rotary cap 1 is provided with a central opening 14 extending through the axial end face of said rotary cap facing away from the body. This opening 14 is provided with a cover seat 15 cooperating with a complementary sealing surface of the central post 12 so as to sealingly close the opening 14 in the closed condition of the rotary cover.

Figure 2A:
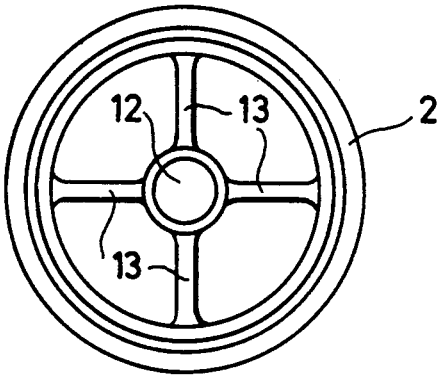
Figure 2B:
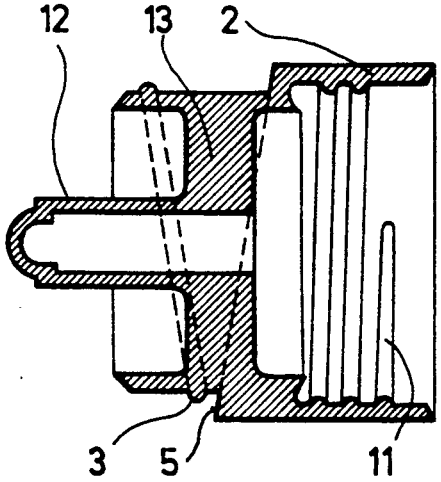
Figure 2C:
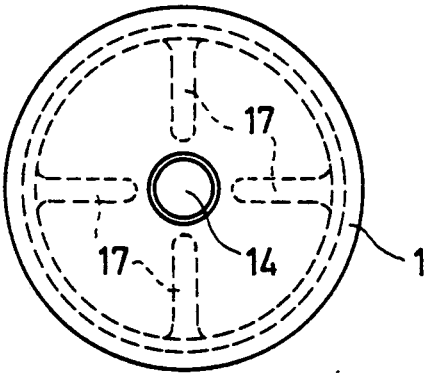
Figure 2D:
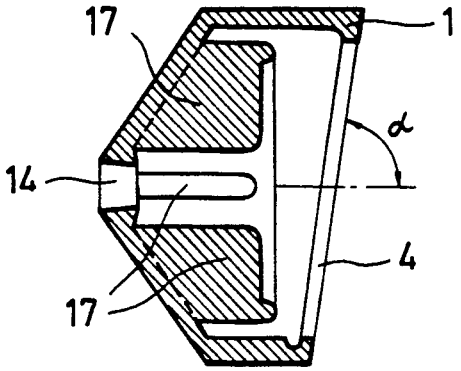
Figure 2E:
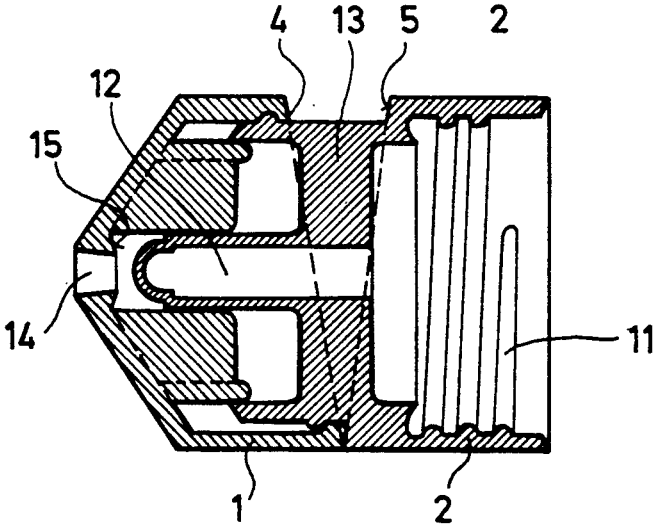

As can be seen in detail from FIG. 2*a* and 2*e*, the body 2 is screwed onto the neck of a receptacle, which is not shown in these figures, by means of a female thread 11 provided on its inner circumferential surface. Such a receptacle can contain a liquid or a powdery filling material in the manner known, and this filling material can be discharged through the opening 14 provided in the rotary cover. The bevelled axial sides 4 and 5 of the rotary cap 1 and of the body 2, which face each other, can be seen especially in FIG. 2*b* and 2*d*. FIG. 2*e* shows the rotary cap 1 and the body 2 in a condition where they are interconnected and in the open position of the rotary cover, in the case of which the central post 12 of the body 2 is detached from the cover seat 15 of the opening 14 so that said opening is free for discharging therefrom filling material contained in a receptacle. In the open position of the rotary cover, the bevelled axial sides 4 and 5, which form part of the rotary cap 1 and of the body 2 and which face each other, diverge, whereas they are in alignment with each other in the closed position of the rotary cover. In connection with these oblique axial sides 4 and 5 of the rotary cap 1 and of the body 2, reference must be made to the fact that these sides can be given by the outer contour of the rotary cap 1 and/or of the body 2, since—as in the case of the embodiment shown in FIG. 1 and 2—the body 2 can be provided with an additional superstructure located above its bevelled side 5 and defined by a concentric circumferential surface, which carries the cam thread 3 on its outer side, the ribs 13 and the central post 12.

However, as will be explained hereinbelow, it is also possible that—in the case of other embodiments of the rotary cover—the rotary cap 1 is provided with such an extension directed towards the body 2, said extension being then also defined by a circumferential surface engaging the body 2.

As shown in FIG. 2*c* and 2*d*, the rotary cap 1 can be provided with four ribs, which, in the case of this embodiment, serve to center the rotary cap 1 relative to the body 2 and which can also fulfil an additional function in the case of the embodiments explained hereinbelow in connection with FIG. 3 and 4.

The additional embodiment of a rotary cover shown in FIG. 3*a* to 3*f* differs from the above-explained embodiment in so far as the ribs 13 within the body 2 are secured to the central post 12 as well as to the inner circumferential surface of the body 2 via hinges 16. The ribs 13, which are thus articulated on the central post 12 as well as on the body 2 via said hinges 16, are elastic and act as leaf springs. Four ribs 17, which are formed in the rotary cap 1, cooperate in a non-postitve mode of cooperation with the central post 12 having a square cros-sectional profile in the case of this embodiment, said ribs 17 being arranged in a mode of arrangement similar to that shown in FIG. 2*c* and outlined in FIG. 3*d* and 3*f*.

Figure 3A:
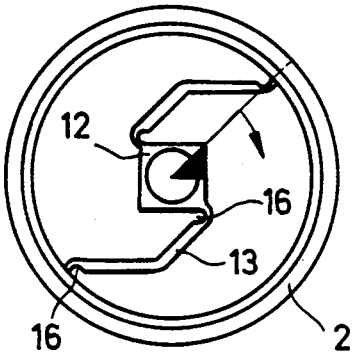
Figure 3B:
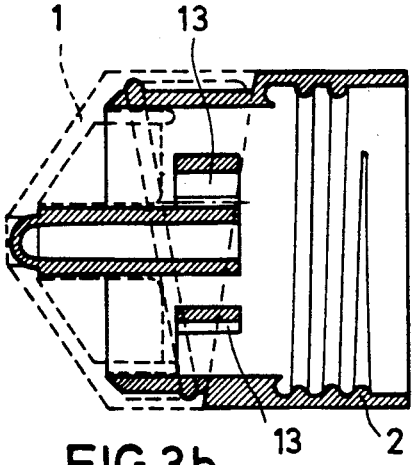
Figure 3C:
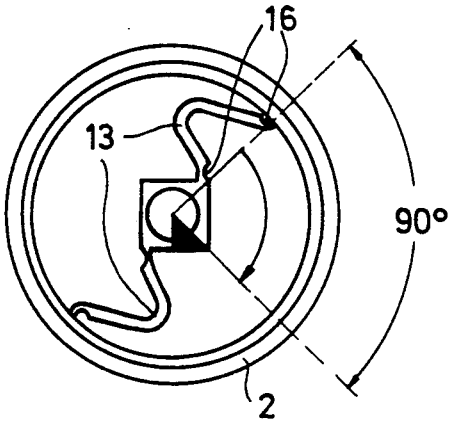
Figure 3D:
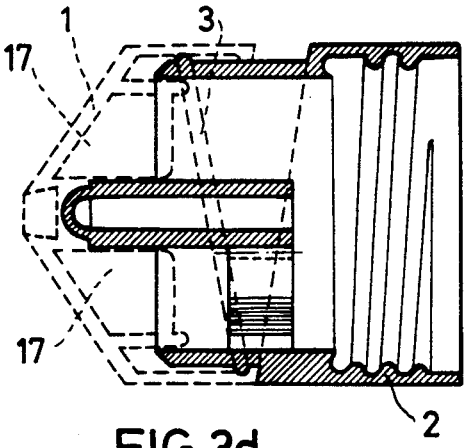
Figure 3E:
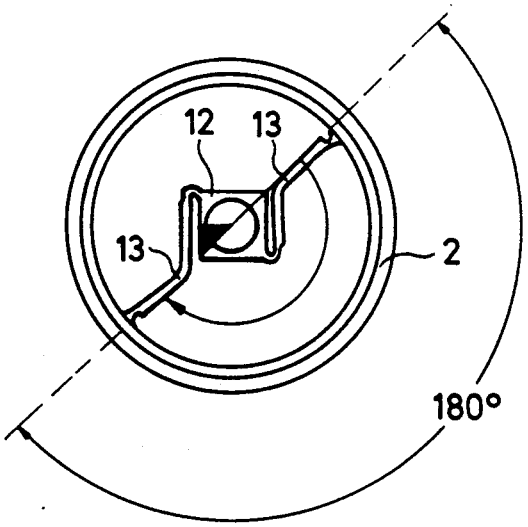
Figure 3F:
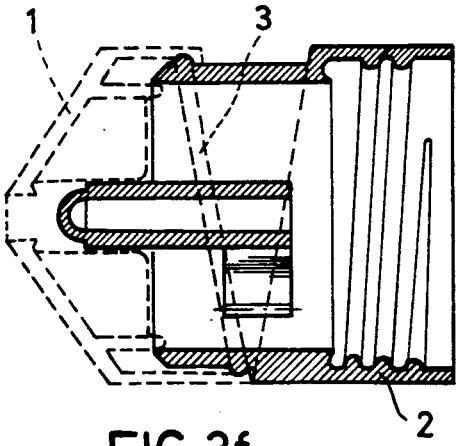
Figure 4A:
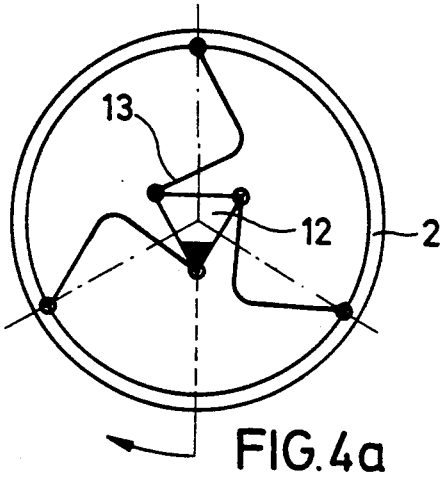
Figure 4B:
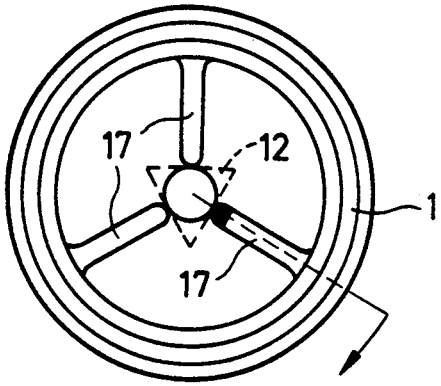
Figure 4C:
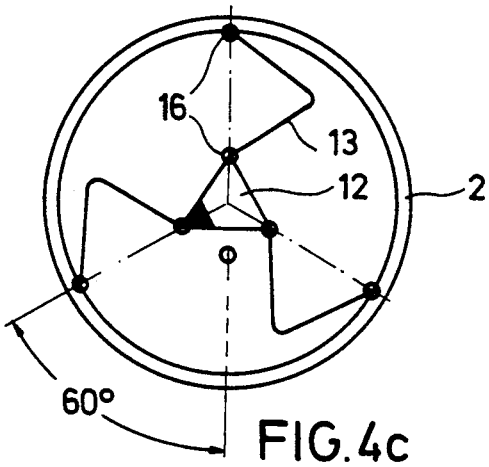
Figure 4D:
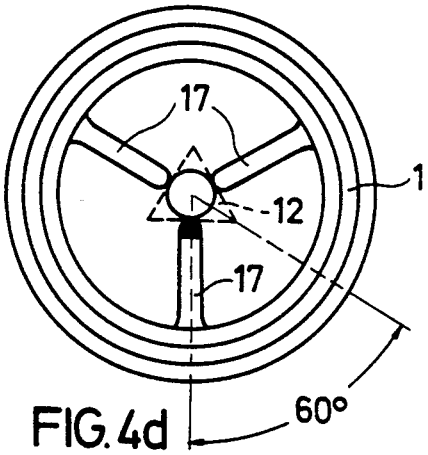
Figure 4E:
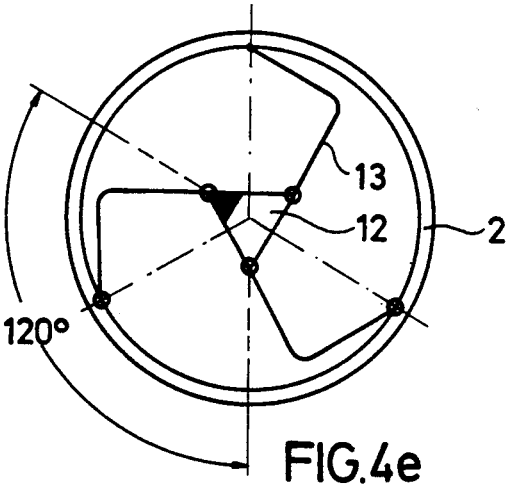
Figure 4F:
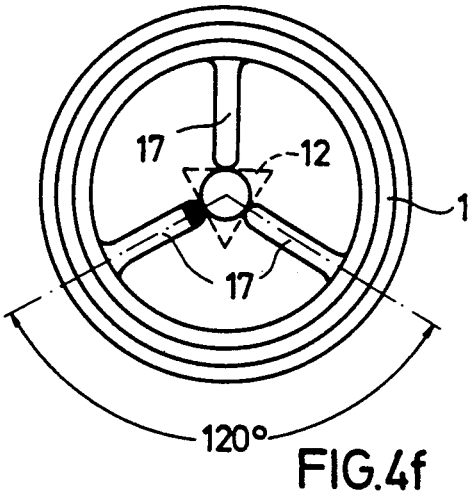

When the rotary cap 1 is rotated relative to the body 2 by 180° with the aid of the cam thread 3, this will not only have the effect that the rotary cap 1 is axially displaced relative to the body 2 in the manner which has already been described, but it will also have the effect that the central post 12 is rotated about the axis of the body 2 by 180° via the ribs 17 in the rotary cap 1. The progress of this rotary movement of the central post 12 is shown in FIG. 3*a*, 3*c* and 3*e*. In the course of this rotary movement, the elastic ribs 13 are deformed in the manner shown, said ribs 13 occupying a first stable position when they are in the position shown in FIG. 3*a*, whereas in the case of the position shown in FIG. 3*c* they occupy an unstable central position in which they are deformed to a maximum extent an exert, consequently, the maximum resetting force on the central post 12 in the direction of said one stable position which is shown in FIG. 3*a* and in the direction of the second stable position which is shown in FIG. 3*e*. In this way, the rotary cap 1 is spring-loaded and pretensioned towards its completely open position and towards its completely closed position so that it is positively fixed in these respective stable positions of the elastic ribs 13.

The remaining structural design of the rotary cover corresponds also in the case of this embodiment to the structural design which has already been explained in connection with the first embodiment.

FIG. 4*a* to 4*f* show a modified version of the embodiment disclosed in FIG. 3. This modified embodiment differs from the embodiment shown in FIG. 3 with regard to the fact that three elastic ribs 13 are provided in the body 2, each of said three ribs being secured via hinges 16 to the central post 12 and to the inner circumferential surface of the body 2 in the same manner. In the case of this embodiment, the cross-sectional profile of the central post 12 has the shape of an isosceles triangle. As can be seen from FIG. 4*b*, 4*d* and 4*f*, the rotary cap 1 is provided with three ribs 17, each of said ribs being in non-positive engagement with a respective side of the central post 12.

As for the rest also this embodiment corresponds with regard to its structural design and its mode of operation to the structural design and the mode of operation described in connection with the previously explained embodiments.

In FIG. 5*a* to 5*e* and additional embodiment of the rotary cover is shown, in the case of which the body 2 itself constitutes the receptacle. The rotary cap 1 is provided with a circumferential surface 6 engaging the interior of the receptacle 2, said circumferential surface 6 having provided therein an opening 9 which extends therethrough in the radial direction. As can be seen from FIG. 5*d* and 5*e*, this embodiment does not require any central post in the body 2. In the case of the closed position of the rotary cover shown in FIG. 5*d*, the opening 9 is fully covered by the circumferential surface of the receptacle 2. Hence, the receptacle 2 is closed.

Figure 5A:
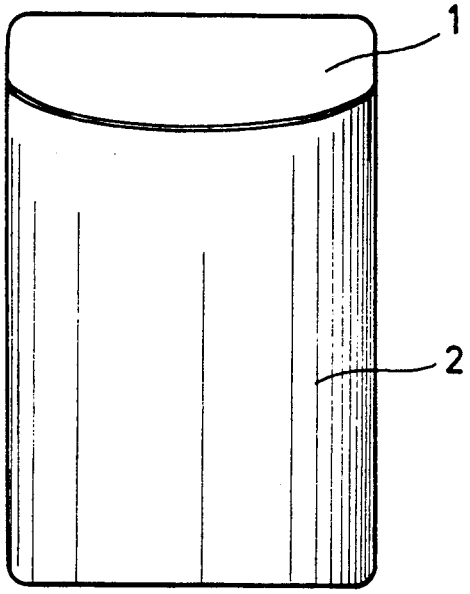
Figure 5B:
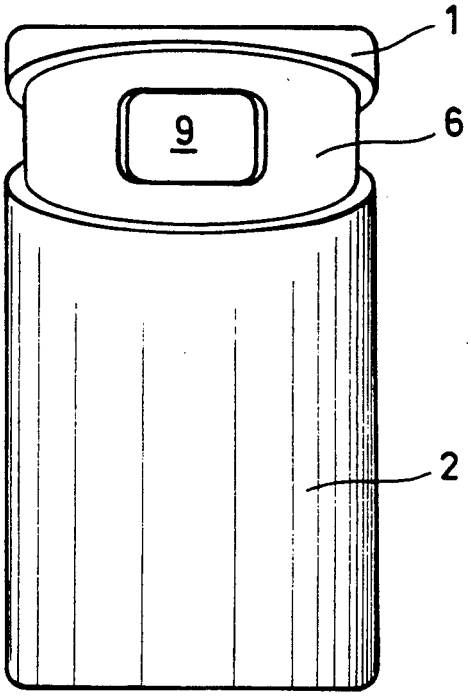
Figure 5C:
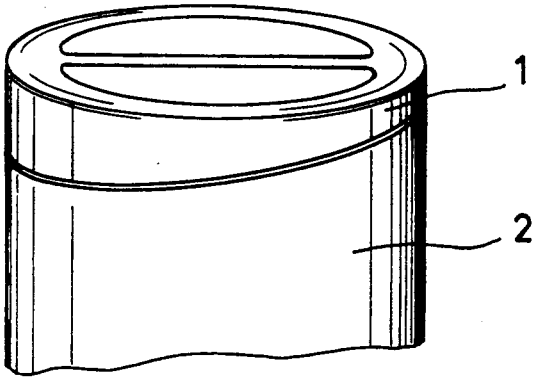
Figure 5D:
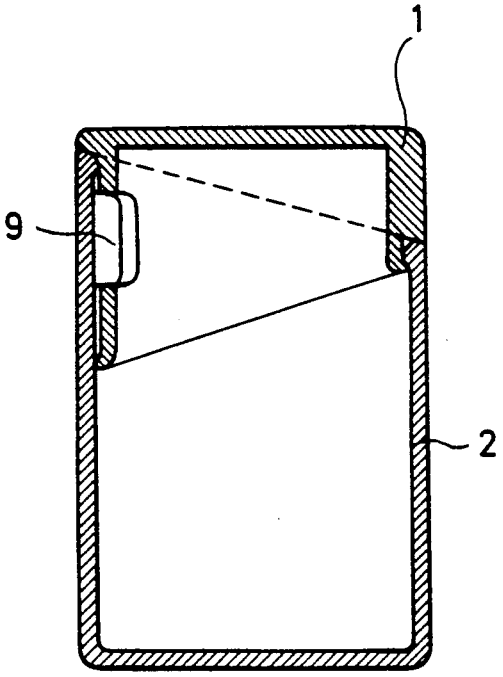
Figure 5E:
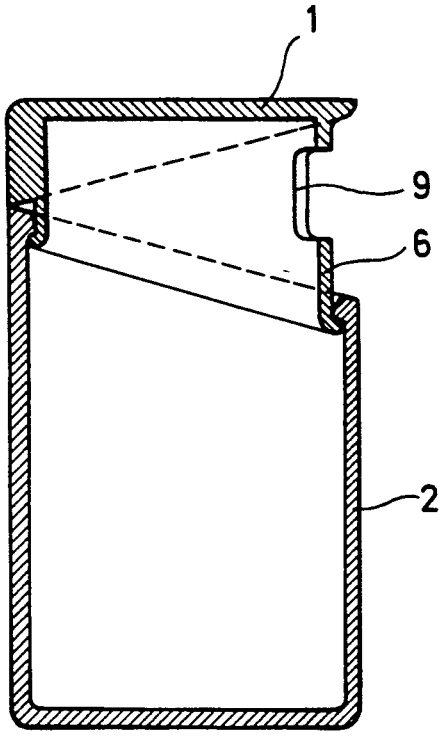

In the case of the open position of the rotary cover shown in FIG. 5*e*, the circumferential surface of the receptacle 2 leaves open the whole opening 9 so that filling material contained in the receptacle 2 can be discharged through the opening 9.

In the case of the additonal embodiment of the rotary cover shown in FIG. 6*a* to 6*e*, the radial opening 9 in the rotary cap 1, which is provided in the case of the previously explained embodiment, is equipped with a discharge spout 10 articulated on the circumferential surface 6 of the rotary cap 1 via a hinge 18. In the open position of the rotary cover shown in FIG. 6*a*, 6*c* and 6*d* , the discharge spout 10 is pivoted outwards by hand or under the influence of the force of gravity so that the filling material contained in the receptacle 2 can be discharged therethrough in the direction desired.

Figure 6A:
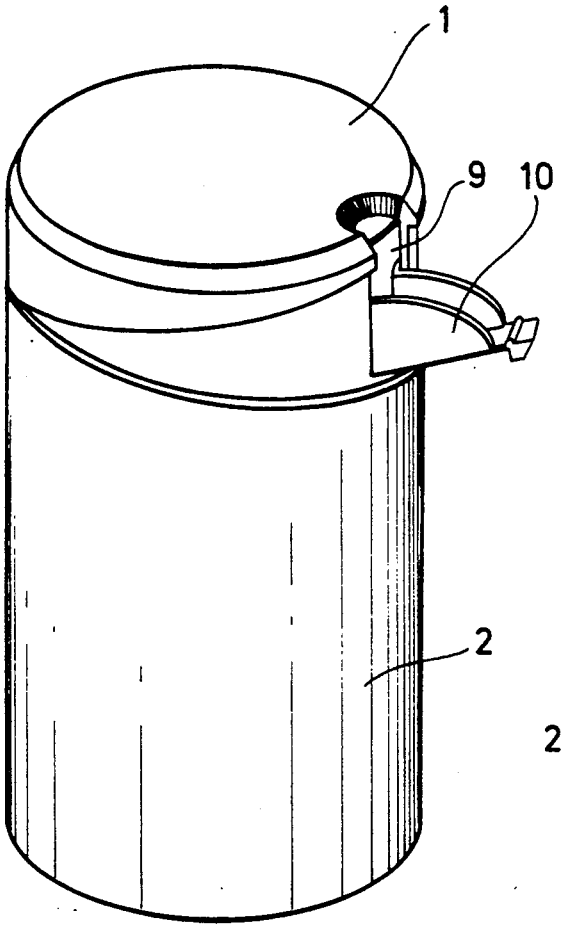
Figure 6B:
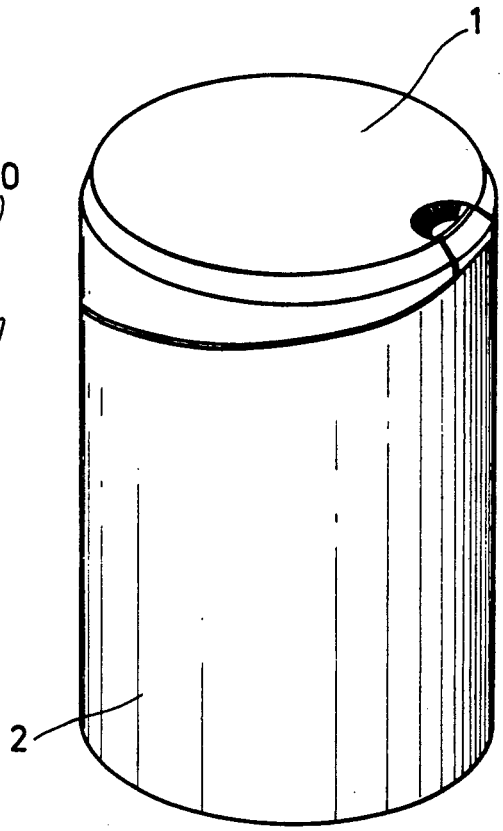
Figure 6E:
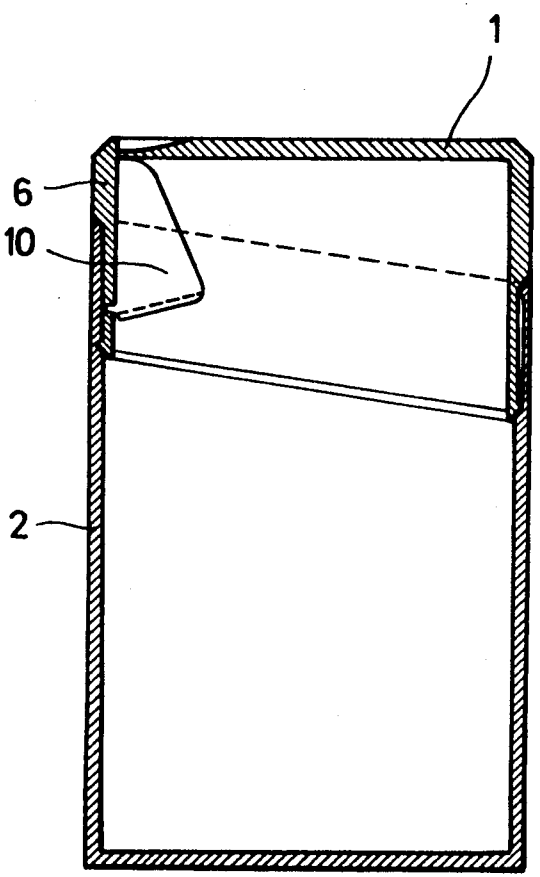
Figure 6D:
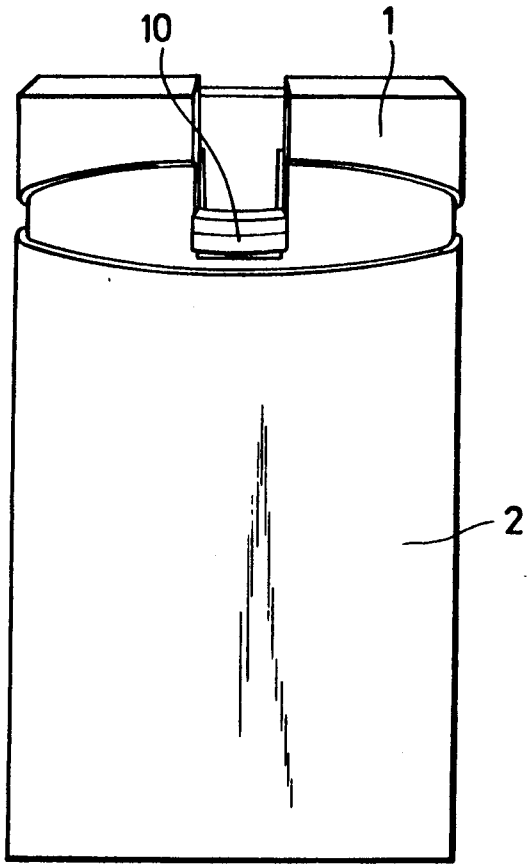
Figure 6C:
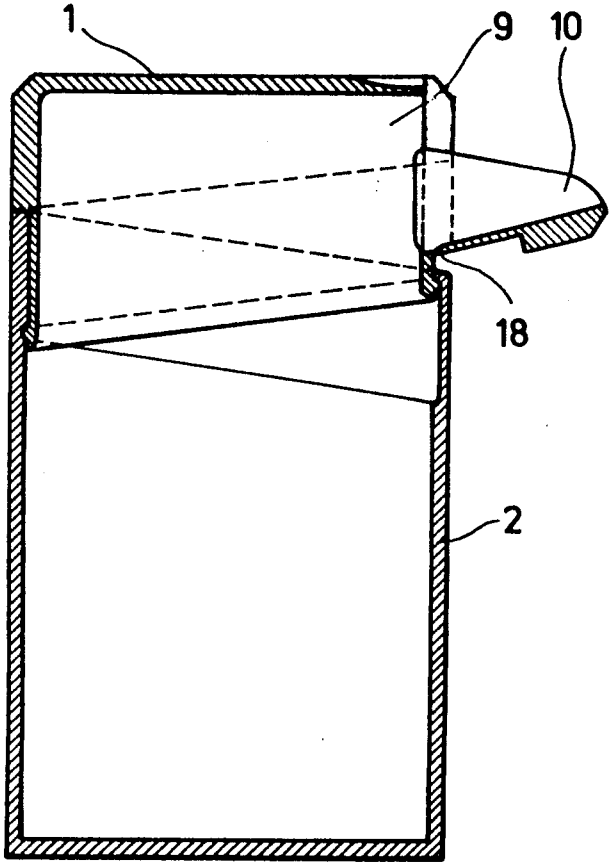

When the rotary cap 1 is rotated by 180° to the closed position of the rotary cover, which is shown in FIG. 6*b* and 6*e*, the discharge spout 10 is pivoted automatically upwards and, consequently, it is pivoted into a position closing the opening 9.

As for the rest, this embodiment corresponds with regard to its structural design and its mode of operation to the structural design and the mode of operation of the embodiment shown in FIG. 5.

Figure 7A:
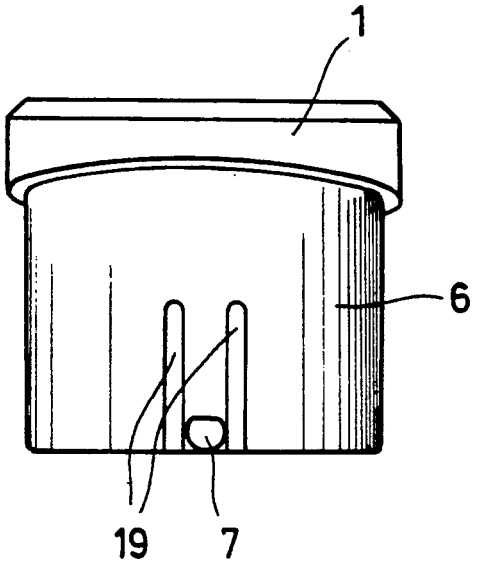
Figure 7B:
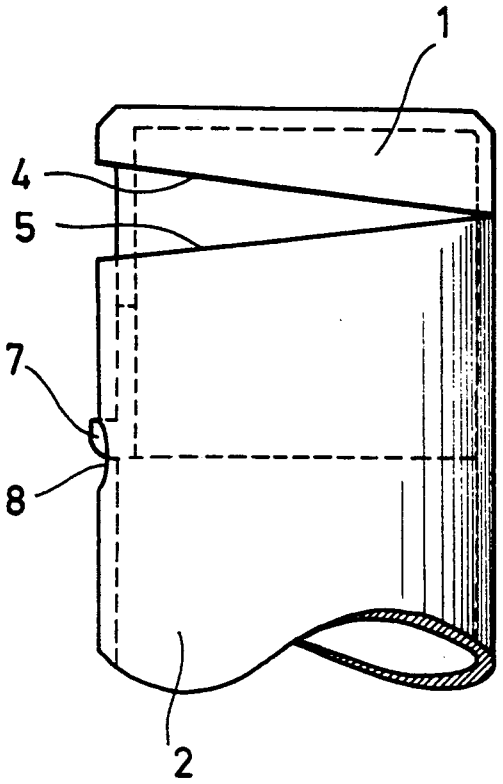
Figure 7C:
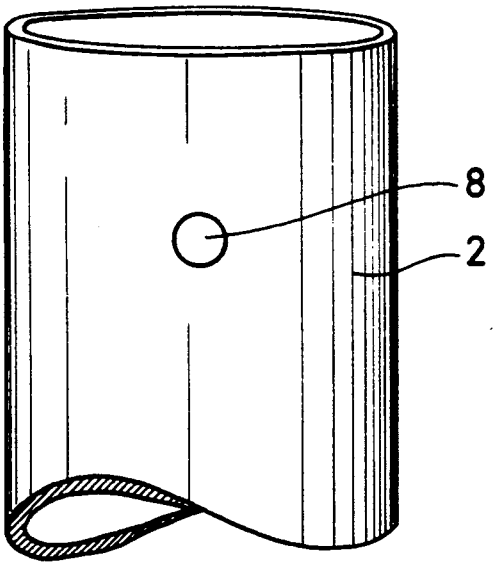

FIG. 7*a* to 7*c* shows an additonal embodiment of the rotary cover so as to demonstrate the manifold possibilities of using such a rotary cover also for other purposes. In the case of this embodiment, the rotary cap 1 serves to close a tube or a hollow-cylindrical bar of the type used e.g. for towel-racks or the like. The circumferential surface 6 of the rotary cap 1, which engages the interior of the body 2, has provided thereon a locking projection 7 in a resilient arrangement with the aid of grooves 19. This locking projection 7 is adapted to engage a locking recess 8, which is provided in the inner circumferential surface of the body 2, this being shown especially in FIG. 7*b*. The mode of arrangement shown in the present connection, in the case of which the rotary cap 1 is locked in the "open position" of the body 2, is not the only possibility of arranging the locking projection 7 and the locking recess 8. As has already been explained hereinbefore, the axial sides 4 and 5 of the rotary cap 1 and of the body 2, which face each other, diverge in this "open position".

It is, on the other hand, also possible to arrange the locking projection 7 and the locking recess 8—in a manner which is not shown in the present connection—in such a way that they interlock when the rotary cap 1 occupies its "closed position", in the case of which the axial sides 4 and 5, which face each other, are in alignment with each other.

In the case of all the embodiments shown and explained, the rotary cap 1 and the body 2 are produced separately as individual components. These components are preferably produced by injection molding from a plastic material or they are produced in some other way. Hence, the rotary cap 1 and the body 2 can have different colors so as to further optimize the aesthetic impression conveyed by the rotary cover.

The rotary cap 1 can have different shapes and patterns on the outside thereof so as to adapt the aesthetic impression to the respective desired requirements and cases of use. It is in this connection also possible to replace the rotary cap 1 by a different rotary cap 1, the rest of the rotary cover remaining unchanged.

Although this is not shown in the drawings in the present connection, the cam thread 3 can be provided with notches so as to provide locking positions for the rotary cap 1 at both end points of the 180° rotation.

In the case of the embodiments shown in FIG. 3 and 4, the body 2, the spring-type ribs 13 and the central post 12 should preferably be produced as an integral component by injection molding from a plastic material. In the case of this embodiment, the spring arrangement defined by the ribs 13 determines the maximum angle of rotation of the rotary cap 1 relative to the receptacle 2, said maximum angle of rotation being again 180°.

I claim:

1. A rotary cover comprising:

a rotary cap (1) for closing an axial opening of a hollowcylindrical body (2), said rotary cap (1) having cam threads (3), said body (2) having corresponding cam threads (3) which cause an axial displacement of said rotary cap (1) relative to said body (2) when the rotary cap (1) is rotated by approximately 180°, said body (2) having a coaxial central post (12) secured to said inner circumferential surface of said body (2) via radial ribs (13) at an end of said body (2) facing said rotary cap (1), said central post having an axial end, said rotary cap (1) having an axial through hole (14) provided in an outer axial end face of said rotoary cap (1), said rotary cap having a cover seat (15) sealingly cooperating with said axial end of said central post (12), said rotary cap (1) having an axial bottom portion (4) and said body (2) having an axial upper ledge (5), said axial bottom portion (4) and said axial upper ledge (5) extending about the entire circumference of the rotary cap (1) and the body portion (2) respectively, said axial bottom portion (4) and said axial upper ledge (5) facing each other and each defining a plane inclined to the normal at a specific angle ($\alpha$) relative to the longitudinal axis of the body (2), and said angle ($\alpha$) depending on the pitch of the cam thread (3) wherein said axial bottom portion (4) and said axial upper ledge (5) are in alignment with each other in a closed position.

2. A rotary cover according to claim 1, characterized in that the radial ribs (13) are equipped with hinges (16), which are provided on the respective rib ends connected to the central post 12 and to the circumferential inner surface, and that the structural design of said ribs (13) is of such a nature that, when the central post (12) is rotated relative to the body (2) about the longitudinal axis of said body, said ribs (13) can be moved to two stable positions between which they pass one instable central position in which the ribs (13), which act as springs, exert a maximum spring force in the direction of the stable positions.

3. A rotary cover according to claim 2, characterized in that the central post (12) has a specific cross-sectional profile, which is acted upon by radially extending additional ribs (17), which are in non-positive engagement with said cross-sectional profile and which the secured to the circumferential surface of the rotary cap (1).

4. A rotary cover according to claim 3, characterized in that the cross-sectional profile of the central post (12) is an isosceles triangle and that three additional ribs (17) are provided on the rotary cap (1).

5. A rotary cover according to claim 3, characterized in that the cross-sectional profile of the central post (12) is a square and that four additional ribs (17) are provided on the rotary cap (1).

6. A rotary cover according to any one of the claims 2, 3, 4, and 5, characterized in that the body (2) and the rotary cap (1) are each produced from plastic material as searate components.

* * * * *

UNITED STATES PATENT AND TRADEMARK OFFICE

CERTIFICATE OF CORRECTION

PATENT NO. : 5,135,139
DATED : August 4, 1992
INVENTOR(S) : Krawagna

It is certified that error appears in the above-identified patent and that said Letters Patent is hereby corrected as shown below:

On the Title page, Under U.S. PATENT DOCUMENTS, delete "Finely" and add --Finley--.

In Column 1, line 27, delete "for" and add --For--.

In Column 3, line 56, delete "an" and add --and--.

In Column 4, line 19, delete "and" and add --an--.

In Column 5, line 47, delete "hollowcylindrical" and add --hollow-cylindrical--.

In Column 6, line 29, delete the "," after the word "that".

In Column 6, line 40, delete "the" and add --are--.

Signed and Sealed this

Nineteenth Day of October, 1993

Bruce Lehman

*Attest:*

BRUCE LEHMAN

*Attesting Officer*

*Commissioner of Patents and Trademarks*